United States Patent [19]

Stahlecker

[11] Patent Number: 4,982,563

[45] Date of Patent: Jan. 8, 1991

[54] SLIVER CONNECTING ARRANGEMENT FOR A SPINNING MACHINE

[75] Inventor: Fritz Stahlecker, Bad Ueberkingen, Fed. Rep. of Germany

[73] Assignee: Hans Stahlecker, Fed. Rep. of Germany; a part interest

[21] Appl. No.: 302,328

[22] Filed: Jan. 27, 1989

[30] Foreign Application Priority Data

Jan. 28, 1988 [DE] Fed. Rep. of Germany ..... 3802414

[51] Int. Cl.[5] ..... D01H 4/48; D01H 15/013

[52] U.S. Cl. ..... 57/261; 19/0.25; 19/159 A; 57/83; 57/263

[58] Field of Search ..... 57/261, 263, 264, 405, 57/83, 90, 22, 281; 19/0.25, 159 A, 157

[56] References Cited

U.S. PATENT DOCUMENTS

| | | | |
|---|---|---|---|
| 4,033,104 | 7/1977 | Kamp | 57/90 X |
| 4,150,534 | 4/1979 | Raasch | 57/90 X |
| 4,156,341 | 5/1979 | Raasch | 57/83 X |
| 4,653,263 | 3/1987 | Stahlecker et al. | 57/83 X |
| 4,798,045 | 1/1989 | Bottarelli et al. | 57/261 X |
| 4,838,018 | 6/1989 | Hoeber | 57/263 |

FOREIGN PATENT DOCUMENTS

| | | |
|---|---|---|
| 0069087 | 1/1983 | European Pat. Off. . |
| 0212979 | 3/1987 | European Pat. Off. . |
| 2536435 | 2/1977 | Fed. Rep. of Germany . |
| 2646313 | 4/1978 | Fed. Rep. of Germany . |
| 3501875 | 7/1986 | Fed. Rep. of Germany . |
| 107952 | 8/1974 | German Democratic Rep. . |

*Primary Examiner*—Joseph J. Hail, III

*Attorney, Agent, or Firm*—Evenson, Wands, Edwards, Lenahan & McKeown

[57] ABSTRACT

In the case of a spinning machine having a plurality of spinning units which are arranged next to one another and to each of which a sliver is fed from a container, a movable servicing device is provided which contains devices for the picking-up of the starting portion of a new sliver from a readied container and for the connecting of this sliver with the end portion of the old sliver entering into the respective spinning unit.

13 Claims, 6 Drawing Sheets

SLIVER CONNECTING ARRANGEMENT FOR A SPINNING MACHINE

BACKGROUND AND SUMMARY OF THE INVENTION

The invention relates to a spinning machine having a plurality of adjacently arranged spinning units, each containing a sliver feeding device for the withdrawal of a sliver from a container and for the introduction of the sliver into the respective spinning unit. Devices are provided for picking up the starting portion of a new sliver of a readied container and for connecting it with the old sliver entering into the respective spinning unit. Devices are also provided for stopping the sliver feeding device in order to leave an end portion of the old sliver which remains outside the spinning unit to be connected with the new sliver.

Reference is also made to our application Ser. No. 07/302,411, filed on Jan. 27, 1989, titled A SLIVER SPINNING ARRANGEMENT FOR SPINNING MACHINES and based on German Application No. P 38 02 413.6 filed on Jan. 28, 1988 in the Federal Republic of Germany.

In the case of a known spinning machine of the initially mentioned type (DE-A No. 35 01 875), it is provided that either the connecting of the end portion of the old sliver with the starting portion of the new sliver takes place such that approximately the same number of fibers exist in the connecting point, or that, before a silver piecing or connection, the fiber feeding device first remains switched on until the connection point between the slivers has entered into the spinning point, the fibers which are fed to the spinning point not being used for the spinning process but being removed as waste.

It is also known (DE-C Nos. 25 36 435 and 26 46 313) to first completely use up the sliver in the respective spinning units and then, as a result, generate a signal by means of which a following is triggered of a container with a new sliver and, if necessary, an automatic threading of the starting portion of the new sliver into the respective spinning unit.

It is also known (DD-PS No. 107 952) to feed the sliver to a fine-spinning machine in large containers which, at the fine-spinning machine, are transferred to smaller containers circulating on a conveying device. The sliver will then enter into the spinning units from the smaller containers. Two of these smaller spinning cans are assigned to each spinning unit, these spinning cans being arranged above one another. The end portion of the sliver of the just-serviced spinning can is connected with the starting portion of the sliver of the spinning can that is located in the supply position or is brought into the supply position, so that a continuous feeding of the sliver is possible.

In the case of drafting units with automatic conveying systems (EP-A No. 0069 087), it is known to grip a starting portion of a sliver hanging down over the edge of a container by means of gripping elements which contain suction devices or pairs of clamping rollers.

It is also known (EP-A No. 0212 979) to arrange an automatic can changing device between two drafting units or frames which is also connected with an automatic device for the joining of the slivers. The filled cans, which leave the first drafting unit, arrive at a revolving table on which they are revolved slowly. The sliver starting portion hanging down over the can edges is then taken off by a suction gripper equipped with a sliver detector which passes this starting portion on to a transfer device which then places the starting portion of this sliver in the intake elements of the second drafting unit.

An object of the invention is to further develop an arrangement of the initially mentioned type by bringing the starting portion of the new sliver into a position in which it can be easily connected with the end portion of the old sliver.

This object is achieved according to the invention in that the devices for picking up the starting portion of the new sliver of the spinning unit and of the end portion of the old sliver remaining outside this spinning unit can be applied such that the end portion of the old sliver and the starting portion of the new sliver overlap one another.

By producing an overlapping of the end portion of the old sliver and the starting portion of the new sliver, a connection can easily be established between the two slivers.

Other objects, advantages and novel features of the present invention will become apparent from the following detailed description of the invention when considered in conjunction with the accompanying drawings.

DETAILED DESCRIPTION OF THE DRAWINGS

Figure 1:
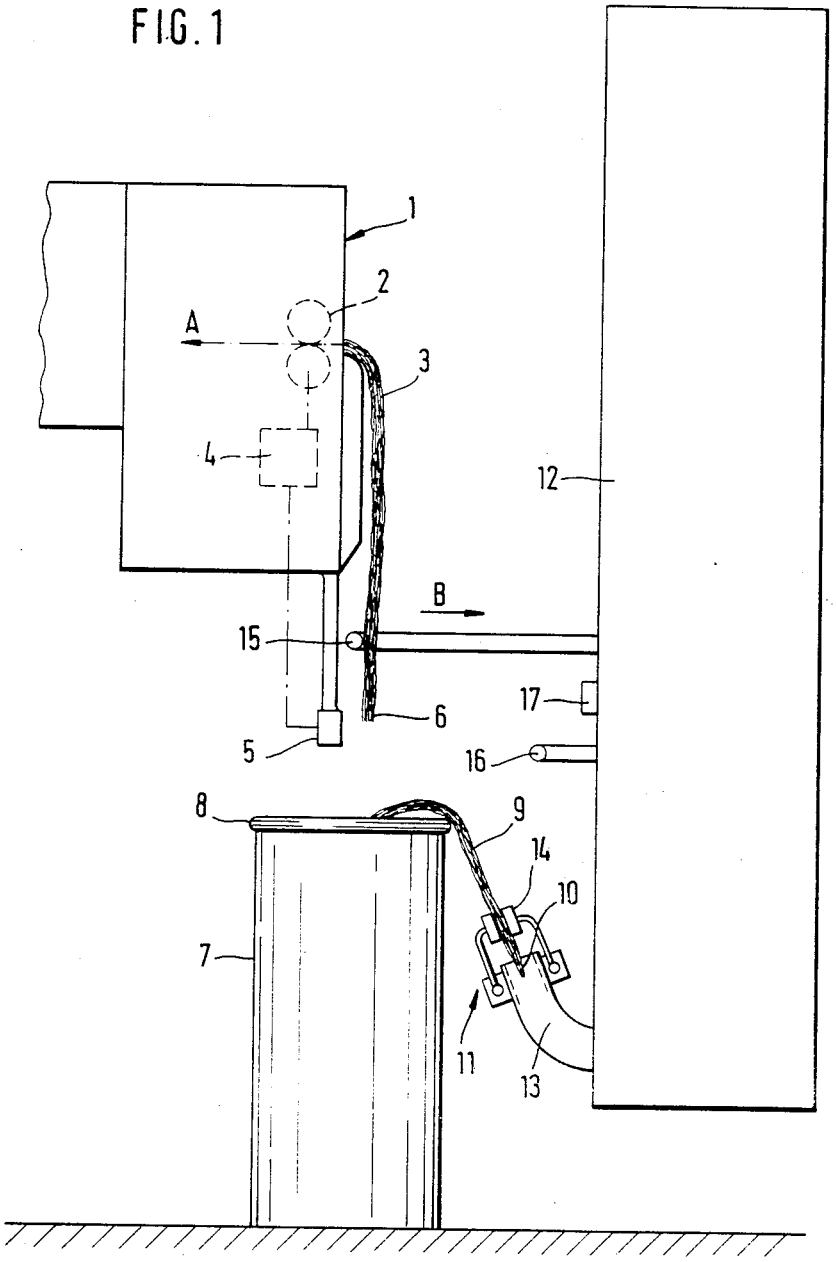
FIG. 1 is a lateral view of a spinning unit of a spinning machine and of a servicing device becoming operative there at, showing the servicing device already gripping the starting portion of a sliver of a readied container, after the spinning unit was stopped while leaving an end portion of the entering sliver which remains outside the spinning unit, constructed in accordance with a preferred embodiment of the invention.

In FIG. 1, a feeding device 2 of a spinning unit 1 of a spinning machine is shown schematically, which machine consists of a plurality of commonly driven such spinning units arranged in a row next to one another. The feeding device 2 is shown as a pair of rollers. This feeding device 2 may, for example, be the pair of intake rollers of a drafting unit or the feeding device to an open-end spinning unit. Differently constructed feeding devices 2 may also be provided in this case, for example, feeding devices in the form of a roller and a feeding table.

A device 4 for interrupting the feeding, which is also shown only schematically, is assigned to the feeding device 2 and may also be realized in different constructions known on the basis of the state of the art. It is contemplated, for example, that this device 4 is a clutch or coupling by means of which the driven roller of the feeding device 2 of the involved spinning point 1 can be stopped individually. It is also contemplated to provide a pinching device which pinches off a sliver 3 entering into the feeding device 2 directly in front of the entry point and thus interrupts a continued feeding.

The device 4 for the interruption of the feeding is coupled with a detector 5 which monitors the sliver 3 entering into the spinning unit 1 with respect to its presence and which stops the feeding device 2 by means of the device 4, as soon as it has noticed the end portion 6 of the entering sliver 3. The further entry of the sliver 3 will then be interrupted so that no further fiber material is conveyed into the spinning unit 1 in the direction of the arrow (A). Therefore, the spinning process will then also be interrupted.

The sliver 3 was fed from a container, such as a so-called spinning can. In FIG. 1, it is shown that the spinning can, from which the sliver 3 was withdrawn, had already been replaced by a spinning can 7 in which a new sliver 9 is made available. The sliver 9 is contained in the spinning can 7 such that its starting portion 10 hangs down over the open edge 8 of the spinning can 7.

A servicing device 12, which can be moved in longitudinal direction of the machine, is shown applied to the spinning unit 1, this servicing device 12 carrying out a connecting of the starting portion 10 of the new sliver 9 with the end portion 6 of the old sliver 3. The servicing device 12 is provided with devices 11 for picking up the starting portion 10 of the new sliver 9. In the shown embodiment, these devices 11 consist of a combination of a pneumatic gripper 13 and of a sliver clamp 14 which is mounted at the pneumatic gripper 13. The thus formed gripping device is applied to the container 7, after which the starting portion 10 of the new sliver 9 is searched and picked up. It may be provided that the starting portion 10 of the sliver 9 is made available at a certain point of the can 7 which is then set up in a certain position so that the devices 11 of the servicing device 12 are correspondingly applied to a very defined point at which they find the starting portion 10 of the sliver 9. It is also contemplated to provide unprepared spinning cans 7, i.e., spinning cans where the starting portion 10 of the sliver 9 is not located at a defined point of the circumference. In this case, the search for the starting portion 10 of the sliver 9 requires a few more expenditures, since either the devices 11 must move around the can 7, or the can 7 must be rotated around a vertical axis for the searching of the starting portion 10. The corresponding devices for this purpose may easily be housed in the servicing device 12.

The devices 11 expediently contain a detector which responds to the starting portion 10 of the sliver 9 and which then, when this starting portion 10 has entered into the suction device 13, switches this suction device off and actuates the sliver clamp 14. In this case, mechanical or optical or electrical detectors may be used. A spring-loaded electromagnet would be suitable as an actuating device of the sliver clamp 14.

Figure 2:
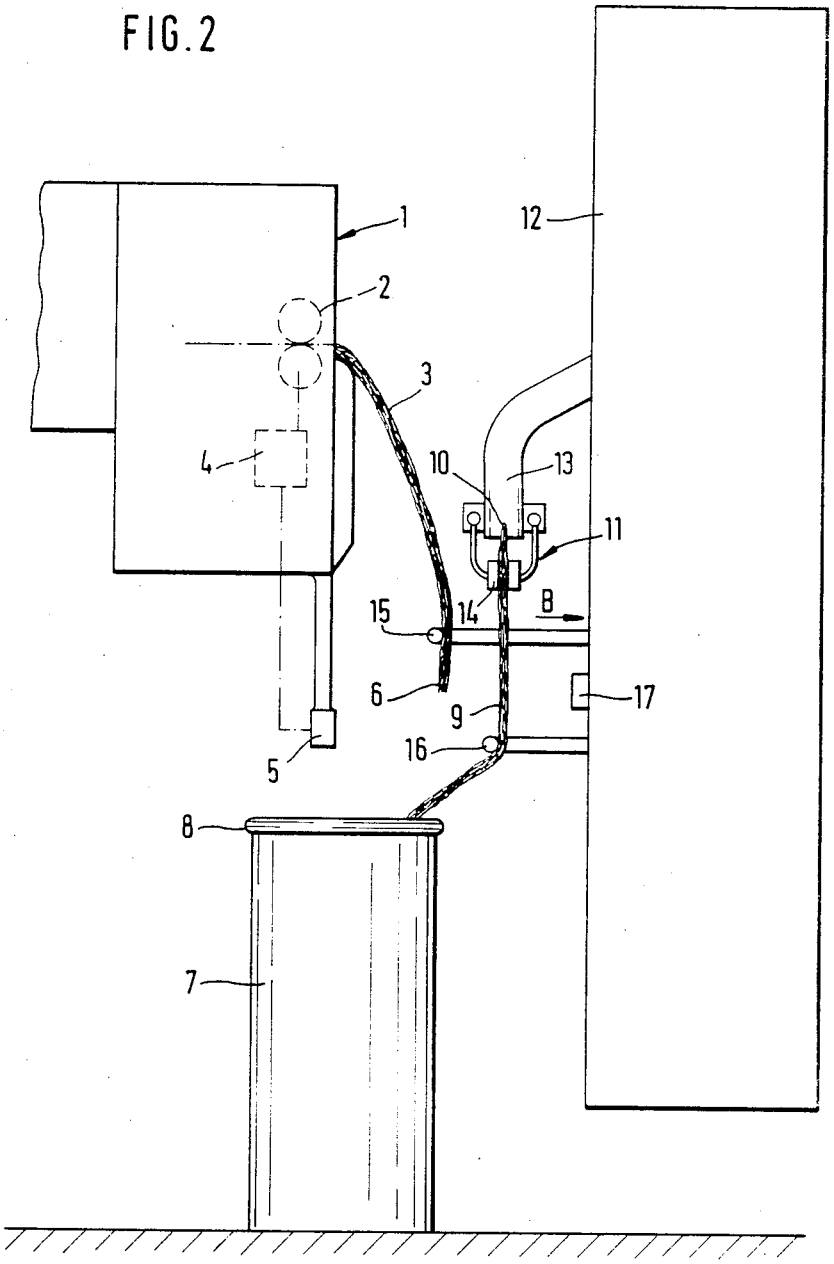
FIG. 2 shows the spinning machine according to FIG. 1 in the next process step, in which the starting portion of the new sliver and the end portion of the old sliver are applied to one another.

The servicing device 12 is equipped with hook-shaped guiding elements 15, 16 which can be moved out of the servicing device 12 in horizontal direction to the spinning unit 1 and back; see direction of the Arrow (B). These hook-shaped guiding elements 15, 16, on the one hand, fetch the end portion 6 of the old sliver 3, while, on the other hand, they also form a guide for the new sliver 9. The devices 11 for the picking-up of the starting portion 10 of the new sliver 9 are moved upward in the servicing device 12, in which case the devices 11 expediently turn around a horizontal axis (FIG. 2) so that the starting portion 10 of the new sliver 9 points upward.

Figure 3:
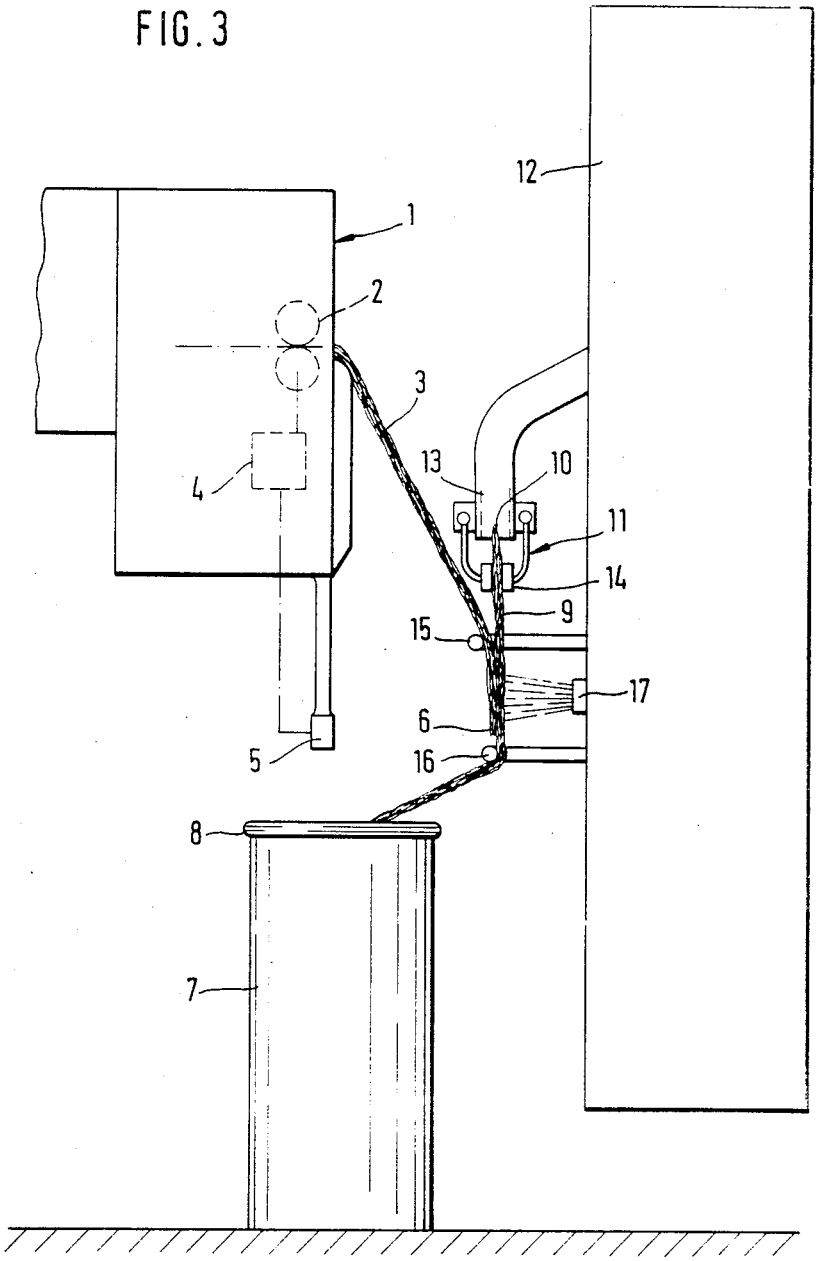
FIG. 3 is a view of the spinning machine of FIGS. 1 and 2, during another subsequent step in which the two slivers are connected with one another.

The guiding elements 15, 16 hold the starting portion 10 of the new sliver 9 and the end portion 6 of the old sliver 3 in such a manner that they overlap one another in the area between the two guiding elements 15, 16 and rest against one another. In this area, the two slivers 3, 9 are then connected with one another. It is shown schematically in FIG. 3 that this connecting takes place pneumatically by means of an air nozzle 17 which aims an air jet at the slivers 3, 9. In practice, a very simplified pneumatic splicing device may be provided because no high demands are made on the quality of the connection. Naturally, the connection may also take place in a different manner, for example, by means of rubbing and/or spraying-on of a hardening gluing element.

Figure 4:
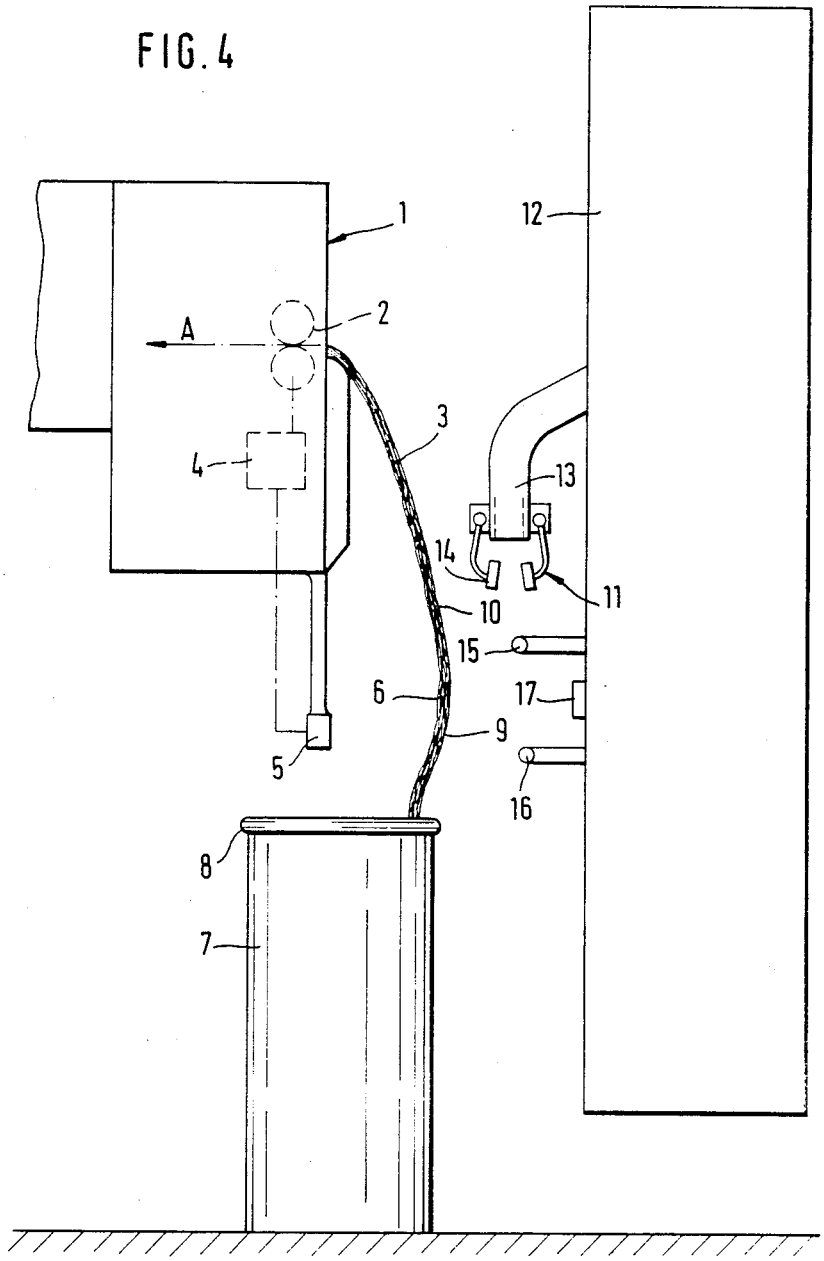
FIG. 4 shows the spinning machine in FIG. 1–3 in another subsequent step, specifically after the two slivers were connected with one another.

After the two slivers 3, 9 are connected with one another, the servicing device 12 releases the starting portion 10 of the new sliver 9. In addition, the guiding elements 15, 16 are withdrawn (FIG. 4). The servicing device 12 will then cause the feeding device 2 to be switched on, specifically long enough for the connecting point between the old sliver 3 and the new sliver 9 to have entered into the spinning unit 1. The amount of sliver which enters in this case is not yet used for the spinning process, but is removed as waste inside the spinning unit 1. The switching-on of the feeding device 2 may be carried out by a direct mechanical actuating of a feeding roller of the sliver feeding device 2 or by means of an electric control of the device 4, for example, by supplying a signal to the detector 5. It is only then that the spinning process is restarted.

The servicing device 12, in a manner, which is not shown in detail, may be constructed such that it carries out the piecing process itself fully automatically. It may also be provided that a separate servicing device is provided which carries out the piecing process. In this case, it may be provided that this separate piecing device controls the feeding device 2, during the piecing, according to a special program in such a manner that a sufficient amount of sliver is first introduced into the spinning unit 1, that the connecting point between the two slivers 3, 9 has entered and was removed as waste, before the piecing process is carried out. In certain cases, it is naturally also contemplated that the thickened connecting point between the two slivers 3, 9 does not interfere with the spinning process; for example, when a very coarse yarn is spun, or if a regulating device follows anyhow.

Figure 5:
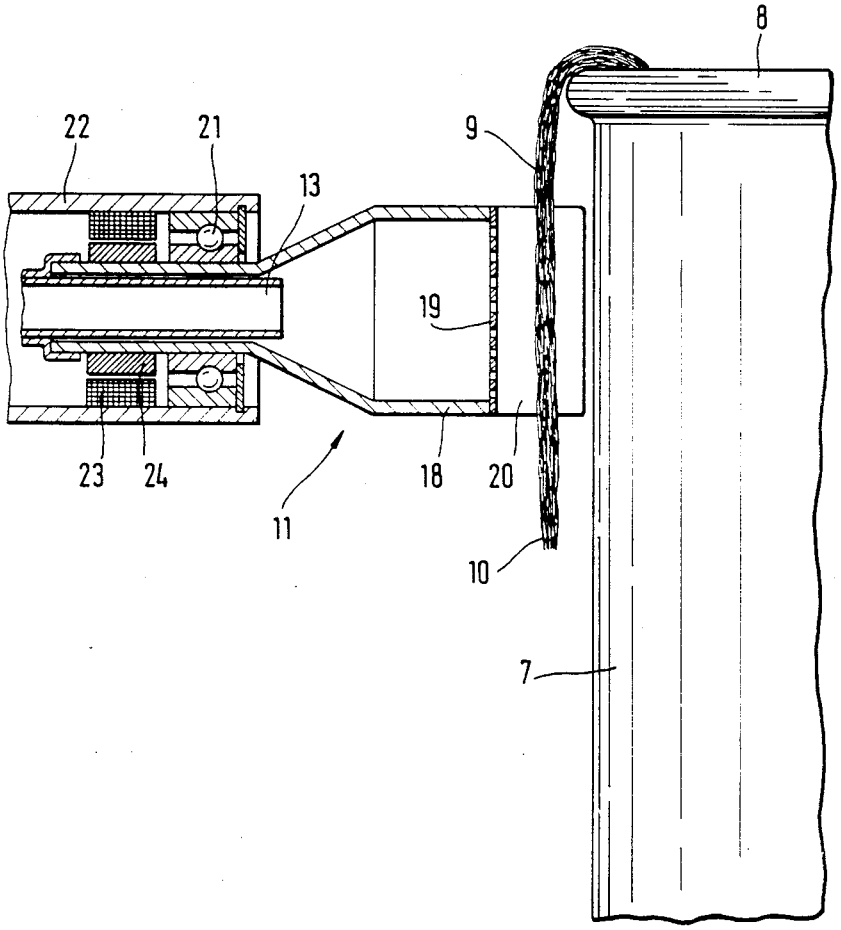
FIG. 5 is an enlarged representation of a gripping device for picking up the starting portion of a sliver at a can of the embodiment of FIG. 1–4.

In FIG. 5, devices 11 are shown at a larger scale for the picking-up of the starting portion 10 of a new sliver 9. Inside a tube-shaped arm 22, a suction tube 13 is disposed which, together with a suction funnel 18, may be applied to the outer circumference of a can 7 in the area below its open edge 8. The suction funnel 18, at its outer end, is equipped with a sieve-type insert 19 so that the sliver 9 is not sucked into the suction gripper 13. Outside the sieve-shaped insert 19, two guiding tabs 20 are disposed which form a V-shaped guiding groove, into which the starting portion 10 of the sliver 9 is sucked. The suction tube 13 or the funnel 18, by means of a roller bearing 21, are disposed inside the arm 22. In addition, a rotary magnet 23, 24 is provided by means of which the suction tube 13, together with the funnel 18 and the two guiding tabs 20, can be rotated around a horizontal axis by 180°, so that the starting portion 10 of the new sliver 9, which at first pointed downward, is now aligned in upward direction.

Figure 6:
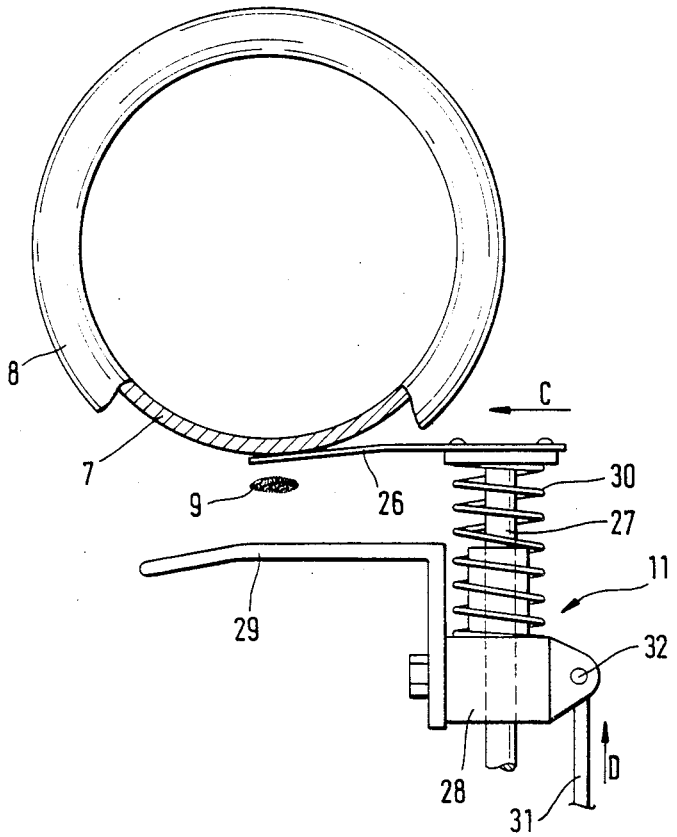
FIG. 6 schematically depicts another embodiment of a device for the picking up of a starting portion of a sliver hanging over the edge of a can, usable with the embodiment of FIGS. 1–4.

In FIG. 6, a strictly mechanical device 11 is provided for the picking-up of the sliver 9 hanging over the edge 8 of a can 7. At a rod 27, which in horizontal direction can be applied to the can 7, a leaf spring 26 is mounted which is applied approximately tangentially to the outer circumference of the can 7 in the direction of the Arrow C. This leaf spring 26 thus reaches behind a sliver 9 hanging over the edge 8. On the rod 27, a sliding guide 28 is arranged at which a bow-shaped clamping element 29 is mounted which extends in parallel to the leaf spring 26. The sliding element 28, by means of an actuating lever 31 of the leaf spring 26 which is applied to a joint 32 and can be moved into the direction of the Arrow (D), can be applied against the effect of a pressure spring 30.

The leaf spring 26 permits a balancing of relatively large tolerances in the position in which the can 7 is deposited since the leaf spring 26 yields in radial direction of the can 7, or, if necessary, causes the can 7 to carry out a small balancing motion by tilting.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A spinning machine comprising a plurality of adjacently arranged spinning units, each unit containing a sliver feeding means for the withdrawal of a sliver from a container and for the introduction of the sliver into the respective spinning unit, sliver splicing means including new sliver pick-up means for picking up the starting portion of a now sliver of a readied container, sliver connecting means for connecting the starting portion with the old sliver entering into the respective spinning unit, and sliver stopping means for stopping the sliver feeding means in order to leave an end portion of the old sliver which remains outside the spinning unit to be connected with the starting portion of the new sliver, wherein the new sliver pick-up means is carried by a mobile servicing apparatus which can be selectively moved to respective spinning units to facilitate to sliver splicing operation, said mobile servicing apparatus including old sliver support means for supporting the end portion of the old sliver and new sliver support means for supporting the starting portion of the new sliver, said old sliver support means and new sliver support means being relatively movable with respect to each other and operable to support the end portions of the old and new sliver in overlapping relation with one another.

2. A spinning machine according to claim 1, wherein the sliver connecting means include means for placing the end portion of the old sliver against the starting portion of the new sliver and connecting them.

3. A spinning machine according to claim 1, wherein the new sliver pick up means contain means for determining the presence of the starting portion of the new sliver.

4. A spinning machine according to claim 3, wherein the new sliver pick up means contain a suction gripper.

5. A spinning machine according to claim 3, wherein the new sliver pick up means contain a sliver clamp.

6. A spinning machine according to claim 1, wherein the new sliver pick up means contain a suction gripper.

7. A spinning machine according to claim 6, wherein the new sliver pick up means can be rotated around a horizontal axis.

8. A spinning machine according to claim 1, wherein the new sliver pick up means contain a sliver clamp.

9. A spinning machine according to claim 1, wherein the new sliver pick up means can be applied to the exterior side of the container with an elastically flexible element.

10. A spinning machine according to claim 1, wherein the new sliver pick up means can be rotated around a horizontal axis.

11. A spinning machine according to claim 1, wherein the mobile servicing apparatus is equipped with means for the switching-on and switching-off of the fiber feeding means of a spinning unit.

12. A spinning machine according to claim 1, wherein said sliver splicing means includes air blowing means for blowing air onto the overlapped old sliver end and new sliver while supported by the servicing apparatus means.

13. A spinning machine according to claim 1, wherein said sliver pick-up means includes a pneumatic gripper and a sliver clamp mounted at the pneumatic gripper.

* * * * *